US005547151A

United States Patent [19]

Giras et al.

[11] Patent Number: 5,547,151

[45] Date of Patent: Aug. 20, 1996

[54] RAILWAY SWITCH MECHANISM

[75] Inventors: Theo C. Giras, Pittsburgh; Joseph A. Profeta, Verona, both of Pa.; Dario Romano, Salerno, Italy

[73] Assignee: Union Switch & Signal Inc., Pittsburgh, Pa.

[21] Appl. No.: 369,685

[22] Filed: Jan. 6, 1995

[51] Int. Cl.[6] ..... B61L 5/00

[52] U.S. Cl. ..... 246/227; 246/231

[58] Field of Search ..... 246/221, 225, 246/226, 227, 231, 253; 310/13

[56] References Cited

U.S. PATENT DOCUMENTS

| | | | |
|---|---|---|---|
| 1,709,206 | 4/1929 | Craft | 246/231 |
| 1,917,837 | 7/1933 | Haddlesay | 246/231 |
| 2,473,661 | 6/1949 | Peabody | 246/231 |
| 3,307,031 | 2/1967 | Frielinghaus et al. . | |
| 3,527,936 | 9/1970 | Abendroth . | |
| 3,696,244 | 10/1972 | Hamley et al. . | |
| 3,865,042 | 2/1975 | DePaola et al. . | |
| 4,610,206 | 9/1986 | Kubala et al. . | |
| 4,611,775 | 9/1986 | Petit . | |
| 4,637,579 | 1/1987 | Hartung . | |
| 4,786,832 | 11/1988 | Nakagawa et al. | 310/13 |
| 4,794,287 | 12/1988 | Hyuga et al. | 310/13 |
| 5,050,823 | 9/1991 | Parker . | |

FOREIGN PATENT DOCUMENTS

| | | | |
|---|---|---|---|
| 159329 | 1/1904 | Germany | 246/231 |

*Primary Examiner*—Mark T. Le
*Attorney, Agent, or Firm*—Buchanan Ingersoll, P.C.

[57] ABSTRACT

A linear induction rail switch mechanism having at least one linear induction motor (LIM) for transversely thrusting a switch track from a first position to a second position. To reduce the frictional forces during transverse movement, the switch mechanism can be levitated from the underlying structures. The switch can have at least one controllable power supply which may supply electric power to an individual LIM or groups of LIMs, which may be three-phase motors. The switch may include a vital controller which is connected to at least one controllable power supply. The vital controller responds to at least one of a feedback signal from a controllable power supply, a feedback signal from a LIM, a feedback signal from a switch track, and a remote signal. The LIM may include a primary inductor which is affixed substantially rigidly to the ground and a secondary which is affixed to the switch track. In some embodiments, the secondary may be a ladder secondary. When the LIM is energized, the ladder secondary becomes magnetically attractable to the primary inductor, and thus the ladder secondary becomes movable responsive to the magnetic field generated by the primary inductor. The controllable power supply used with the switch can include a solid state power converter having a controlled output voltage, which may employ a pulse-width-modulation scheme. The solid state power converter may be a variable-voltage, variable-frequency converter, although a variable-voltage fixed-frequency converter also may be employed.

15 Claims, 4 Drawing Sheets

RAILWAY SWITCH MECHANISM

BACKGROUND OF THE INVENTION

1. Field of the Invention

The present invention relates to railway switch mechanisms, particularly to railway switch mechanisms which operate to move mechanical rail portions, thereby transferring train traffic between alternate tracks, through motive force from electric motors, and more particularly to railway switch mechanisms which receive motive force from linear induction motors.

2. Description of the Prior Art

Current rail switch mechanisms use the established principles of mechanical advantage through devices such as gears, cranks, and lever arms to direct the path of the wheels of a train from one set of tracks to an alternate track. In addition, such mechanical devices are generally motivated by electrical and/or pneumatic linear/rotary actuators. Some such switch mechanisms uses a DC motor and a high-torque gear box (sideways worm-gear, screw-jack or spur-gear arrangement), and lubricated rail-support pads, which can require maintenance. In such switching mechanisms, a substantial portion of the actuator effort is directed to overcoming the effects of static friction and resistance, including coulomb and viscous friction forces. In addition, the actuator must be powerful enough to crush any ballast, snow or foreign matter that may have become lodged between the switch points.

The railroad industry has promulgated recommended operating guidelines for power-operated switch mechanisms which are to be met by existing and new switch mechanisms. Once such guideline is illustrated in FIG. 1. Typically, switch points move approximately six inches from one track to the other track. FIG. 1 indicates that an initial breakaway force of 400 pounds is required to overcome forces such as static friction in the system. During the next four inches of switch travel, torque is increased approximately linearly to about 900 pounds to overcome other oppositional forces such as friction and other viscous forces. To ensure switch point closure, the actuator is required to increase force on the switch to approximately 2500 pounds over the last one inch of travel to crush any matter such as ballast which may be entrapped between the main track and the switch.

Another switch design criteria requires that low voltage mechanisms with 20 volts at the motor terminals and high voltage mechanisms with 110 volts at the motor terminals must be capable of pulling 3800 pounds at end of stroke without damage. The switch mechanism must be designed so that it can be stopped, reversed, or obstructed at any point of its movement without damage. In addition, the switch mechanism must prevent movement due to vibration or external forces applied to the connections. Further, the switch mechanism in the locked position must be capable of withstanding stress equivalent to a thrust of 20,000 pounds either on the switch operating or locking connection. Also, a crank contact interlock must be provided to prevent the motor from operating while the crank is inserted, and until such contact has been reset.

SUMMARY OF THE INVENTION

The invention provides a linear induction rail switch mechanism having at least one linear induction motor (LIM) for transversely thrusting a switch track from a first predetermined position to a second predetermined position. To reduce the frictional forces which may be encountered during transverse movement, the switch mechanism also can be levitated from the underlying structures. The switch also can have at least one controllable power supply for providing electric current to the LIM. Although it is possible to operate more than one LIM with one controllable power supply, it is preferred that each LIM be provided power by a respective controllable power supply. The switch also may include a vital controller which is connected to at least one controllable power supply. The vital controller responds to at least one of a feedback signal from a controllable power supply, a feedback signal from a LIM, a feedback signal from a switch track, and a remote signal. The LIM may include a primary inductor which is affixed substantially rigidly to the ground and a secondary which is affixed to the switch track.

In some embodiments, the secondary may be a ladder secondary. When the LIM is energized, the ladder secondary becomes magnetically attractable to the primary inductor, and thus the ladder secondary becomes movable responsive to the magnetic field generated by the primary inductor. The controllable power supply used with the switch can include a solid state power converter having a controlled output voltage. In some embodiments, the output voltage may be controlled using pulse width modulation. The solid state power converter may be a variable-voltage, variable-frequency converter, although a variable-voltage fixed-frequency converter also may be employed. Some embodiments use a linear induction motor that is a three-phase LIM.

In order to maintain a substantially constant air gap between the primary induction and a ladder secondary when a LIM is energized, a spacer which is disposed between the primary inductor and the ladder secondary may be provided. Further, some embodiments also can include a clamp mechanism for locking the rail switch in a predetermined position. The clamp connects with the rail switch and the vital controller, and provides the vital controller with a switch point position indication.

BRIEF DESCRIPTION OF TEE DRAWINGS

Figure 3A:
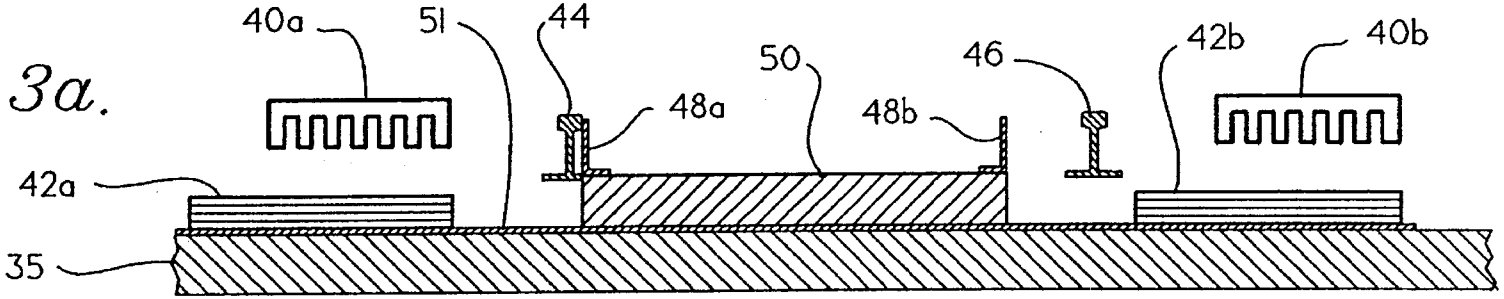

FIG. 3*a* is a side-view illustration of a linear induction rail switch according to the present invention while in a first predetermined position.

Figure 3B:
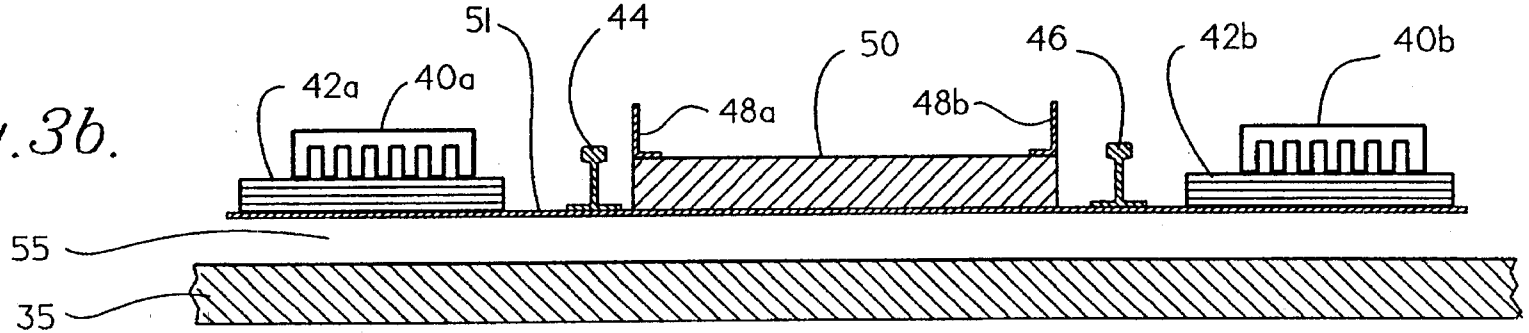

FIG. 3*b* is a side-view illustration of a linear induction rail switch according to the present invention while in operation.

Figure 3C:
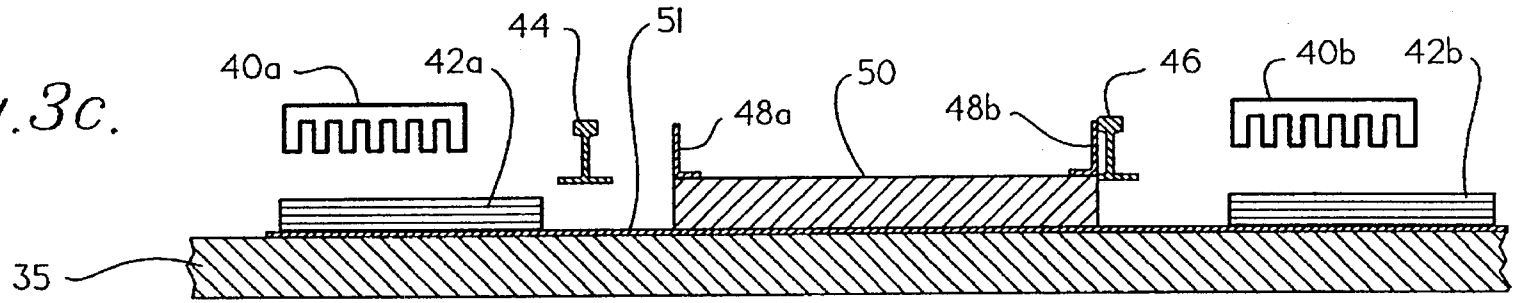

FIG. 3*c* is a side-view illustration of a linear induction rail switch according to the present invention while in a second predetermined position.

Figure 1:
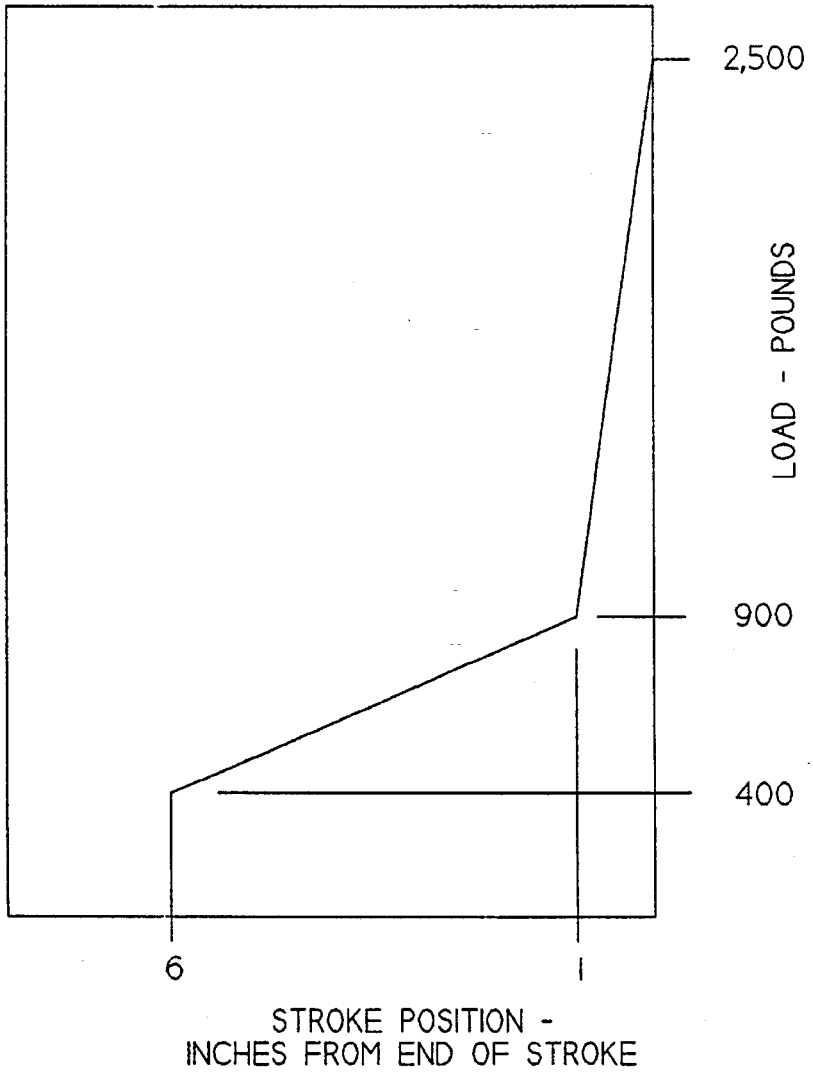
FIG. 1 is an illustration of a recommended operating guideline for test load requirements for power-operated switch mechanisms.
Figure 4:
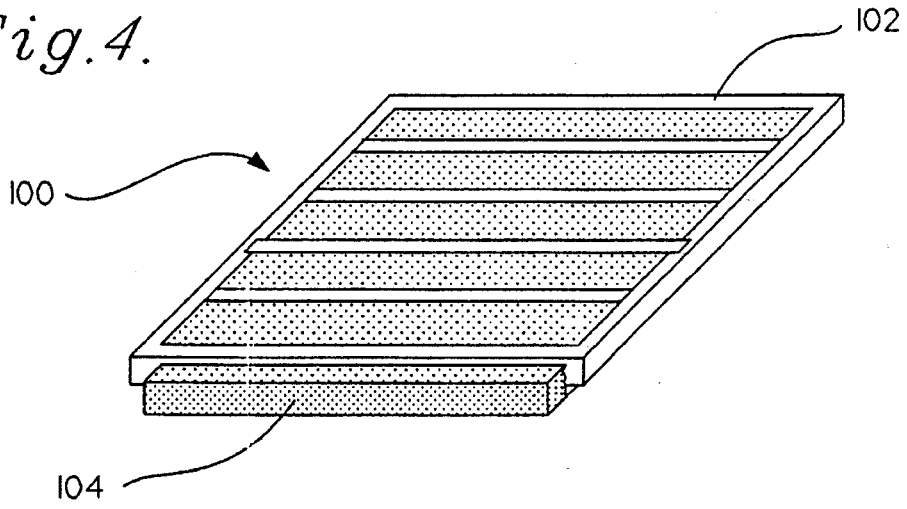

FIG. 4 is an illustration of a ladder secondary inductor according to the present invention.

Figure 5A:
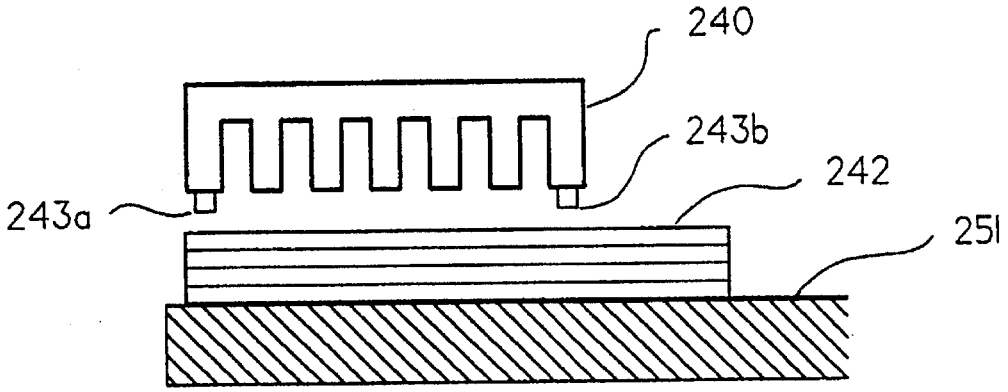

FIG. 5*a* is an illustration of one de-energized linear induction motor employing guide spacers, according to the present invention.

Figure 5B:
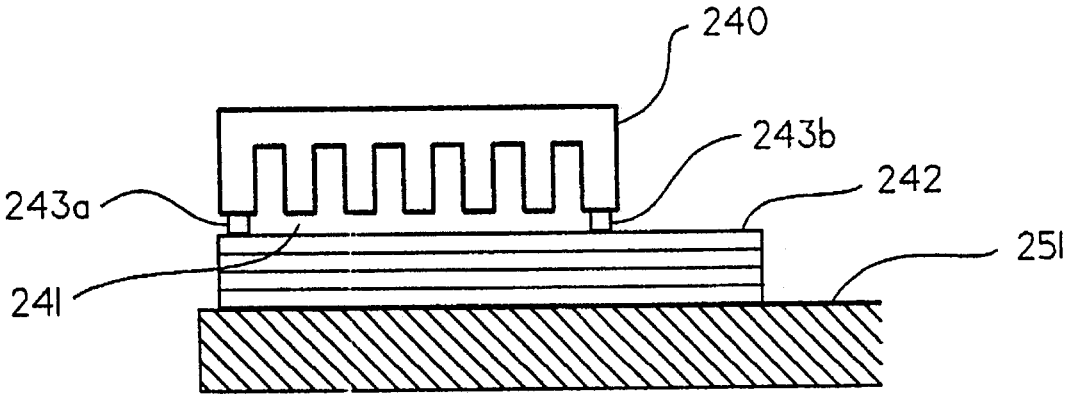

FIG. 5*b* is an illustration of one energized linear induction motor employing guide spacers, according to the present invention.

DETAILED DESCRIPTION OF THE PREFERRED EMBODIMENT

The linear induction rail switch employs linear induction motor technology to convert the motion created by the electromagnetic field of an electric motor into a linear motion used to drive a rail switch track from a first position to a second position. The attraction force in the LIM is used to overcome friction, or coulomb forces, and, in some embodiments, levitate a certain length of switch track off of switch sliding pads. In this way, frictional resistance can be reduced while performing transverse motion during point-to-point switching. Although sufficient levitation and transverse motion of the switch may be provided by a single LIM, it may be preferred that the switch provide two LIMs, with one motor being located on each side of the track. These LIMs can be operated together to provide the lift force and thrust necessary to lift the tracks from their resting position and to move the rail switch to another position.

At least one controllable power supply is provided to at least one LIM. Each controllable power supply may include at least one solid-state power converter, most preferably a variable-voltage, variable-frequency converter. So that the LIMs for the respective switch may be operated in a push-pull configuration, a solid state power converter may be provided for each of the two LIMs for each respective switch. In this configuration, the switch allows for fault-tolerant operations. For example, if one of the LIMs, or power converters, is unable to operate, the working components can continue to provide switch operation. A controller can provide fault-tolerant control of the switch, including the controllable power supply and the LIMs, perform necessary checks before the state of the switch is changed, and monitor the status of the switch operating mechanism for possible malfunction.

Because of the capability of providing transverse motion directly, this presently preferred embodiment can eliminate the need for a gear box, or translating unit. In addition, the slide bar, i.e, the mechanical linkage between the electric controller and the operator, may be eliminated.

Other details, objects, and advantages of the invention will become apparent as the following descriptions of present embodiments thereof proceeds, as shown in the accompanying drawings.

Figure 2:
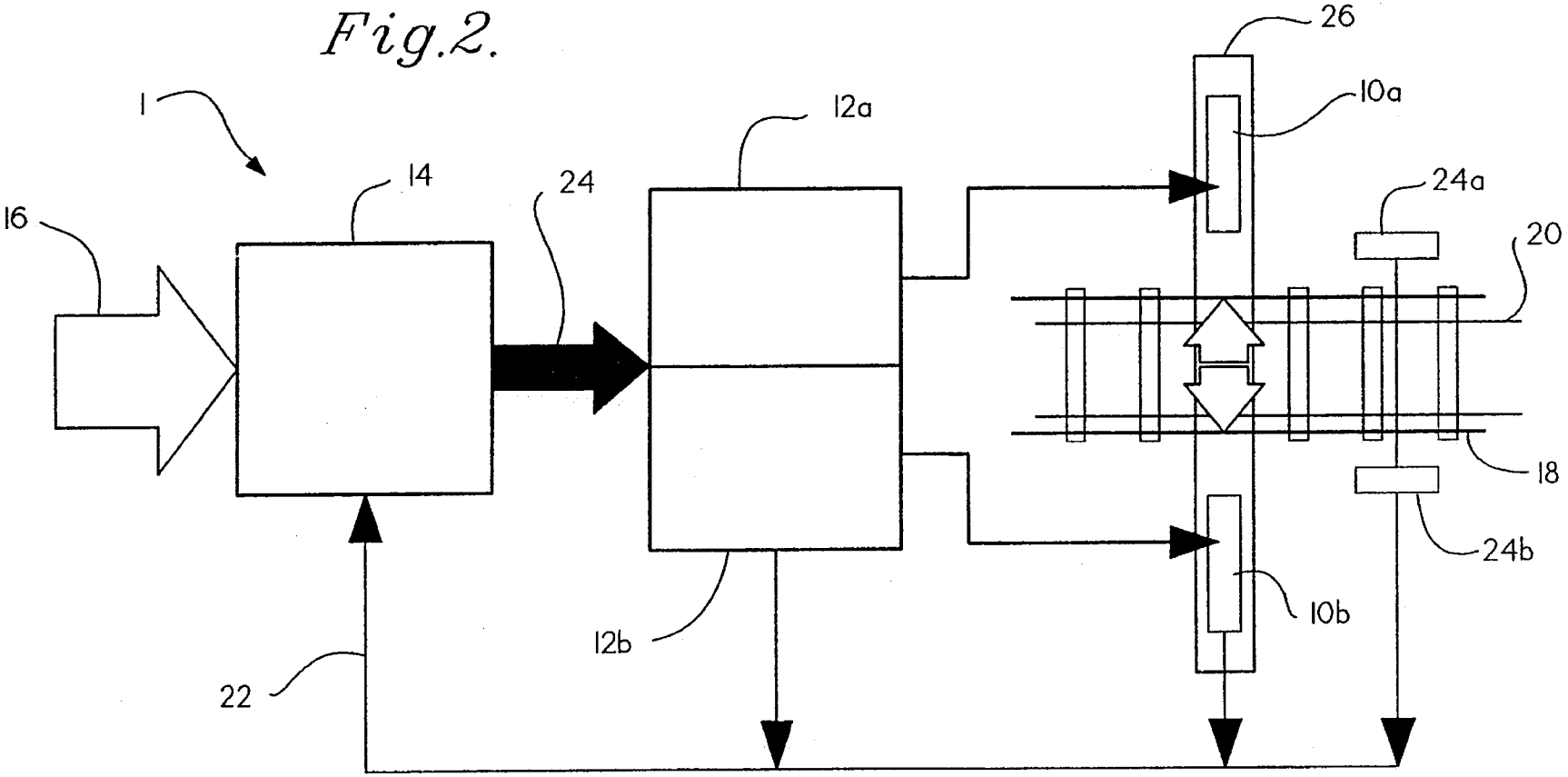
FIG. 2 is a diagram of a linear induction rail switch according to the present invention.

As shown in FIG. 2, two linear induction motors 10*a*, 10*b* may be provided for the linear induction rail switch 1, although switch 1 may be operable with only one LIM. It is contemplated to provide two controllable power supplies 12*a*, 12*b* to provide electric current to respective LIM 10*a*, 10*b*. It is desirable to design switch 1 to include fault-tolerance; therefore, each of controllable power supplies 12*a*, 12*b* may each be reconfigurable to provide electric current to LIM 10*a*, 10*b*, or both.

LIMs 10*a*, 10*b* are preferred to be three-phase induction motors which may require three-phase power for operation. Accordingly, the desired AC voltage, and the current needed to excite the LIM stators, may be delivered using controllable power supplies having solid state semiconductor switching devices such as, for example, GTO or IGBT switching devices. It is further preferred to use variable-voltage, variable-frequency power converters in controllable power supplies 12*a*, 12*b* in order to achieve improved efficiency during the lift and the transverse movement. However, variable-voltage, fixed-frequency converters may also be used. The effective voltage output may be achieved by operating the switching devices according to a predetermined method. In this embodiment, the effective output voltage is achieved using different pulse width formed by pulse width modulation methods in controllable power supplies 12*a*, 12*b*.

Controller 14, which may be a vital controller, can provide control and configuration information to controllable power supplies 12*a*, 12*b*. The motion of switch track 20 with respect to main track 18 may be commanded from a remote location using remote signal 16 which is supplied to controller 14. Power supplies 12*a*, 12*b*, LIMs 10*a*, 10*b*, and clamp means 24*a*, 24*b* can provide feedback signal 22 which permits controller 14 to monitor the states, position, and motion status of the system, switch point position, and lock indication. Controller 14 may also perform system testing and self-diagnostic tests. Clamp means 24*a*, 24*b*, can provide a mechanical locking action which satisfies railroad industry design criteria. In addition, clamp means 24*a*, 24*b* can provide switch point position and lock indication information to controller 14 by way of feedback signal 22, although rail switch information may be provided via signal 22 by means other than clamp means 24*a*, 24*b*, such as, for example, from sensors directly placed on tracks 18, 20.

Typically, system operation can proceed as thus: a human operator in a remote control center can send to switch 1 a command to change the position of switch track 20 by providing remote signal 16 to controller 14. Controller 14, in turn, provides operational signal 24 to controllable power supplies 12*a*, 12*b*. Power supplies 12*a*, 12*b* can provide power to respective LIMs 10*a* and 10*b*. Initially, the power supplied to LIMs 10*a*, 10*b* generates a vertical attraction force or thrust to levitate switch track 20 and supporting structures 26 away from the ground or reduces the normal gravitational force area on the support structures. Once these coulomb and frictional forces are reduced or overcome, the electromagnetic fields of LIMs 10*a*, 10*b* are manipulated to provide lateral motion, transverse to the orientation of main track 18. Lateral motion of support structures 26 and switch track 20, relative to main track 18, accomplishes the desired motion. The LIMs can be designed such that the lateral force generated by LIMs 10*a*, 10*b*, together or alone, can be sufficient to crush any ballast or other material that may have become lodged between the switch points. Once switch track 20 is positioned relative to main track 18, it is preferred to lock switch track 20 into the predetermined position using clamp means 24*a*, 24*b*.

FIGS. 3*a*–3*c* illustrate the operation of the switch to change the position of switch track from a first predetermined position to a second predetermined position. FIG. 3*a* shows switch rails 48*a*, 48*b* in a first position. In this first position, switch point 48*a* is substantially in contact with main rail 44; switch point 48*b* is spaced apart from main rail 46. In FIG. 3*a*, primary inductors 40*a*, 40*b* are de-energized and, therefore, primary inductors 40*a*, 40*b* exert essentially no attractive force towards secondaries 42*a*, 42*b*, respectively. It may be preferred that primary inductors 40*a*, 40*b* be rigidly affixed to, and elevated from, the ground 35. Also, it may be preferred that secondaries 42*a*, 42*b* be affixed to rail switch support structure 51 which is, in turn, affixed to rail switch support structure 50 and switch rails 48*a*, 48*b*.

When electric current is selectively applied to primary inductors 40*a*, 40*b*, an attraction force is generated between primary inductors 40*a*, 40*b* and secondaries 42*a*, 42*b*, respectively. Static friction is overcome, causing secondaries 42*a*, 42*b*, affixed support structures 51, 50, and switch rails 48*a*, 48*b* to be levitated from the ground 35. Transverse motion of switch rails 48*a*, 48*b* relative to main rails 44, 46 is accomplished by creating rotating magnetic fields in primary inductors 40*a*, 40*b*, thereby moving laterally secondaries 42*a*, 42*b*. After the lateral, transverse motion is completed, switch rail 48*b* is substantially in contact with main rail 46, and switch rail 48*a* is substantially spaced apart from main rail 44.

With the switch rails 48*a*, 48*b* in the second predetermined position, as shown-in FIG. 3*c*, primary inductors 40*a*, 40*b* are de-energized, thereby permitting the attractive force to dissipate. Without the attractive force, secondaries 42*a*, 42*b*, support structures 50, 57, and switch rails 48*a*, 48*b*, are drawn back to the ground 35 by gravitational forces. Transverse motion in the opposite direction can be accomplished by creating the attractive force illustrated in FIG. 3*b* and causing the electromagnetic field impressed upon primary inductors 40*a*, 40*b* to rotate in the opposite direction.

Although other configurations for a secondary may be used, secondary 100 can be a ladder secondary as shown in FIG. 4. It may be preferred that cage 102 be made of aluminum, and that back reaction plate 104 be composed of iron, more preferably laminated iron. Plate 104 thus may be designated as "back iron." Alternately, secondary 100 can be composed of a flat aluminum plate affixed to back iron 104. By the preferred configuration of secondary 100, the existence of a longitudinal component of current density, in addition to a transverse component, in the reaction cage is reduced, thereby essentially canceling transverse edge effects and decreasing the secondary Joule losses, thus increasing the LIM power factor.

FIG. 5*a* shows one LIM including primary inductor 240 and secondary 242 in the de-energized state. Also illustrated are mechanical supporting spacer guides 243*a*, 243*b*. When electric current is applied to primary inductor 240, as is shown in FIG. 5*b*, secondary 242 is attracted thereto. The attraction force can be used to provide a complete levitation action on secondary 242 and switch track support structure 251. However, it may be desirable only to reduce and control the friction force in order to allow a smooth transverse movement. In either case, mechanical support guide spacers 243*a*, 243*b* can act to keep essentially constant the air gap 241 between primary inductor 240 and secondary 242, thereby simplifying the control function.

While certain embodiments of the invention have been illustrated, it is understood that the invention is not limited thereto but may be otherwise variously embodied and practiced within the scope of the following claims.

We claim:

1. A railway switch mechanism for controlling traffic between alternative rail tracks comprising:

a. at least one linear induction motor for vertically and transversely thrusting a switch track from a first predetermined position to a second predetermined position and said at least one linear induction motor being operably connected with said switch track;

b. at least one controllable power supply connected to said at least one linear induction motor, for providing electric current to said at least one linear induction motor; and c. a controller, connected to said at least one controllable power supply, said controller being responsive to at least one of a feedback signal from said at least one controllably power supply, a feedback signal from said at least one linear induction motor, a feedback signal from said switch track, and a remote signal.

2. The railway switch mechanism of claim 1 wherein each of said at least one linear induction motor further comprises:

a. a primary inductor substantially rigidly affixed; and b. a secondary connected to said switch track, said secondary being selectively magnetically attractable to said primary inductor, and said secondary being movable responsive to a magnetic field generated by said primary inductor.

3. The railway switch mechanism of claim 2 wherein said at least one linear induction motor is a three-phase linear induction motor.

4. The railway switch mechanism of claim 2 wherein the secondary is configured in a ladder secondary.

5. The railway switch mechanism of claim 1 wherein said at least one induction motor also levitates said switch track.

6. The railway switch mechanism of claim 1 further comprising a spacer disposed between said primary inductor and said secondary, said spacer being a predetermined thickness to maintain a substantially constant air gap between said primary inductor and said secondary when said at least one linear inductor motor is energized.

7. The railway switch mechanism of claim 1 wherein each of said at least one controllable power supply further includes at least one solid state power converter having a voltage-controlled output, and said voltage-controlled output is pulse width modulated.

8. The railway switch mechanism of claim 6 wherein said at least one induction motor also levitates said switch track.

9. The railway switch mechanism of claim 7 wherein said at least one solid state power converter is a variable-voltage, variable-frequency converter.

10. The railway switch mechanism of claim 1 further comprising clamp means for locking said switch track in a predetermined position, and said clamp means connectable with said switch track and said controller, and said clamp means providing at least one of switch point position indication and lock indication to said controller.

11. The railway switch mechanism of claim 1 wherein said controller is selectably connectable with each of said at least one controllable power supply and each of said at least one controllable power supply is selectably connectable with respective ones of said at least one linear induction motor such that said controller may operate selected ones of said at least one linear induction motor.

12. The railway switch mechanism of claim 7 further comprising:

a. a plurality of linear induction motors, respective ones of a pair of said plurality of said linear induction motors being disposed on opposite sides of said switch track; and b. said at least one power supply including a plurality of solid state power converters, respective ones of a pair of said plurality of said solid state power converters being selectively connected with said respective ones of said pair of said plurality of said linear induction motors so that said pair of linear induction motors are operable thereby in a push-pull configuration.

13. The railway switch mechanism of claim 12 wherein said plurality of linear induction motors also levitate said switch track.

14. A method for transferring traffic flow from a first track to a second track, comprising the steps of:

a. actuating at least one linear induction motor, each of said at least one linear induction motor having a primary inductor and a secondary, respective ones of said secondary being affixed to a railway switch track;

b. creating a vertical attractive force, responsive to said actuating, between a primary inductor of said at least one linear induction motor and a secondary said at least one of said linear induction motor;

c. applying a horizontal thrusting force to one side of said railway switch track, said thrusting force being oriented in a first direction; and d. applying a horizontal thrusting force to the other side of said railway switch track, said thrusting force being oriented in said first direction.

15. The method of claim 14 for transferring traffic flow from a first track to a second track, said creating said attractive force further comprising the step of levitating said switch track.

* * * * *